US006193517B1

(12) United States Patent
Lazecki

(10) Patent No.: US 6,193,517 B1
(45) Date of Patent: Feb. 27, 2001

(54) SIMULATOR FOR FRONT-LOADED BARREL WEAPONS

(75) Inventor: René Lazecki, Sax (CH)

(73) Assignee: SE Schweizerische Elektronikunternehmung (CH)

( * ) Notice: Subject to any disclaimer, the term of this patent is extended or adjusted under 35 U.S.C. 154(b) by 0 days.

(21) Appl. No.: 09/294,992

(22) Filed: Apr. 19, 1999

(30) Foreign Application Priority Data

Apr. 20, 1998 (EP) ..... 98810345

(51) Int. Cl.[7] ..... F41A 33/00
(52) U.S. Cl. ..... 434/12; 434/16
(58) Field of Search ..... 434/12, 18, 19, 434/21, 22, 24; 89/22

(56) References Cited

U.S. PATENT DOCUMENTS

| | | | | |
|---|---|---|---|---|
| 2,322,212 | * | 6/1943 | Allen | 434/24 |
| 2,801,586 | | 8/1957 | Mongello | 102/49 |
| 2,809,624 | | 10/1957 | Becher et al. | 124/11 |
| 3,452,453 | * | 7/1969 | Ohlund | 434/22 |
| 3,798,795 | * | 3/1974 | Michelsen | 434/19 |
| 4,321,043 | * | 3/1982 | Grimmer et al. | 434/18 |
| 4,877,403 | * | 10/1989 | Jurgens | 434/24 |
| 5,201,658 | * | 4/1993 | Taylor et al. | 434/18 |

FOREIGN PATENT DOCUMENTS 1453821 2/1969 (DE) .

* cited by examiner

*Primary Examiner*—Sam Rimell
(74) *Attorney, Agent, or Firm*—Ostrolenk, Faber, Gerb & Soffen, LLP

(57) ABSTRACT

A simulator for front-loaded barrel weapons, e.g. a mine thrower simulator, is provided with an outlet opening at the lower end of the launcher tube through which the shots, e.g. grenades, exit the launcher tube, thus allowing realistic training conditions. Both the ammunition and the simulator preferably comprise sensors and controls which collect the data from the sensors and perform a first evaluation. The results are transmitted to a computer in the custody of the trainer, which delivers the final evaluation and the calculation of the point of impact, inter alia.

27 Claims, 4 Drawing Sheets

SIMULATOR FOR FRONT-LOADED BARREL WEAPONS

BACKGROUND OF THE INVENTION

1. Field of the Invention

The present invention relates to a simulator for front-loaded barrel weapons and suitable ammunition therefor.

2. Discussion of the Related Art

Simulation systems for the training of the operation of military weapons systems offer different advantages and are of increasing interest. Among other things, fewer security precautions or none at all are required while training for real large-range weapons systems, in addition to the severe security precautions for the trainees, large areas, which in some cases can be difficult to find, have to be closed in order to avoid personal and material damages. Ultimately, training on simulators generally involves lower costs and may therefore be performed more intensely. Also, simulators permit training with respect to situations which can only be created in reality with great complications, if at all, such as the influence of the weather, or shooting in developed areas. In the case of weapons systems requiring relatively expensive ammunition, e.g. front-loaded barrel weapons such as mine throwers, shell throwers, and rocket launchers, reusable ammunition is particularly advantageous.

Inter alia, known mine thrower simulator projects suffer from the fact that decisive aspects of the simulation do not correspond to reality, thereby inducing dangerous errors in the operation of real systems. In known constructions, after firing, the shot, i.e. the mine, grenade, illuminating grenade etc. remains in the barrel, from where it must be removed. To this end, it is suggested to pull out the shot from the barrel by means of a suitable tool. On one hand, in reality, this manipulation is extremely dangerous on the other hand, a mine thrower simulator does not allow for practicing serial firing of shots in the fastest possible succession.

An alternative to pulling out the shot consists in the automatic ejection of the grenades. One possibility is to use a very weak propelling charge, while another possibility is to provide a spring or pneumatic or hydraulic cylinders or the like. The first possibility is noisy and involves the consumption of propelling charges, and the latter one requires the manual or motorized bending of the spring or the generation of the pneumatic or hydraulic pressure, respectively. However, a power driven bending resp. generation of the pressure in turn requires a relatively strong energy source, which is generally not available in a realistic situation. In any case, all these ejection techniques again require security precautions as the grenades are ejected to a distance of some meters. Also, in the case of a bad landing e.g. on the tail fin, the expensive simulation grenade may be damaged or destroyed, and the fuse in the point may be damaged even in a regular landing. Ultimately, practice mines or grenades must be laboriously located and collected after the training.

SUMMARY OF THE INVENTION

It is an object of the present invention to provide a simulator for front-loaded barrel weapons which allows a realistic training of the operation thereof while avoiding at least one of the above-mentioned drawbacks.

This object is attained by a simulator for front-loaded barrel weapons wherein the launcher tube is provided at its lower end with an outlet opening allowing a respective shot to drop out. The invention also provides particular ammunition suitable for the simulator of the invention.

BRIEF DESCRIPTION OF THE DRAWINGS

The invention will be explained by means of an exemplary embodiment with reference to the following figures.

DETAILED DESCRIPTION OF THE INVENTION

Figure 1:
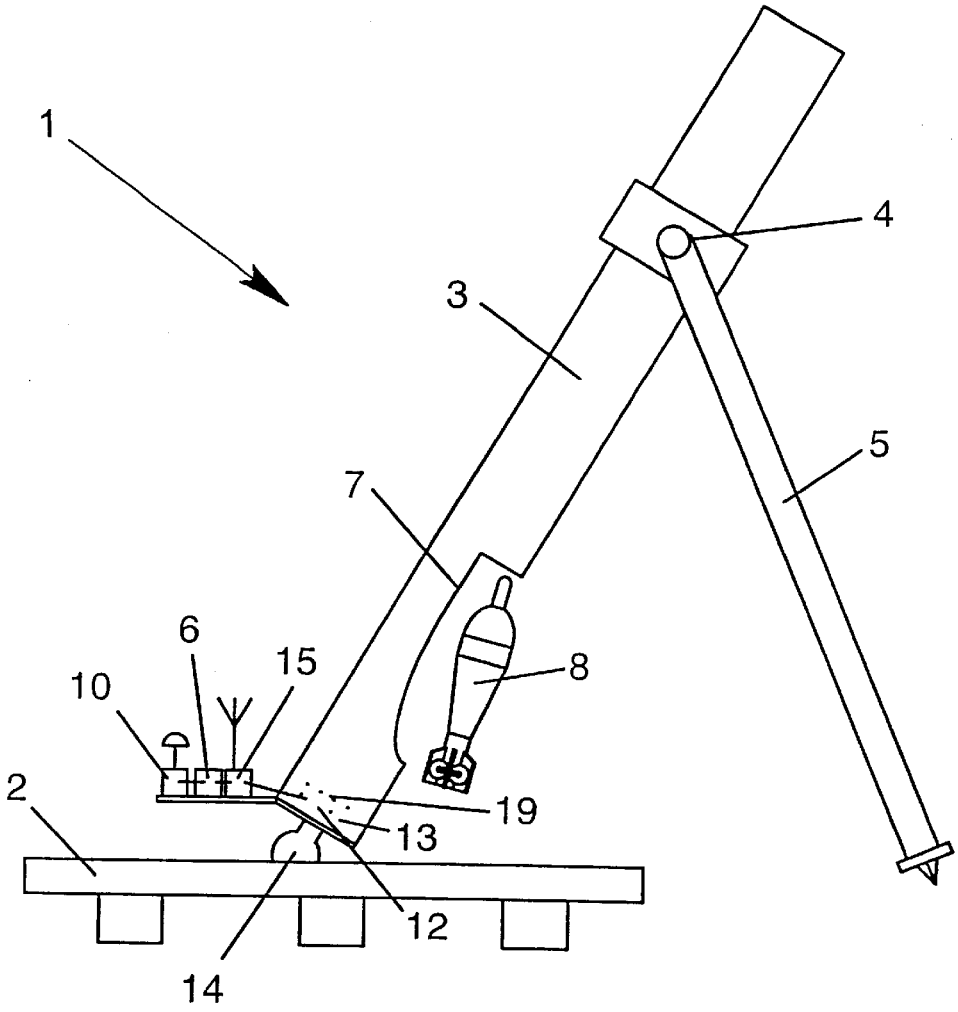
FIG. 1 schematically shows an embodiment of a side elevational view of a mine thrower simulator constructed according to principles of the invention.

With respect to its appearance, mine thrower simulator 1 of the invention resembles a "real" mine thrower. Launched tube 3 is pivotably mounted on base plate 2. The upper portion of launcher tube 3 is movably connected to post 5 by a sighting and adjusting unit 4. Since, for the purpose of the simulation, the alignment of launcher tube 3 is measured by an electronic compass, inter alia, the simulator is largely made of an antimagnetic material in the area of the compass, especially base plate 2 and launcher tube 3, in order not to disturb sensitivity to the magnetic field of the earth. This material may e.g. be aluminum, an aluminum alloy, or brass.

The lower end of launcher tube 3 is provided with outlet opening 7 from which grenade 8 drops out from the lower end of launcher tube after having been inserted and "fired" by the trainee. The small height from which the grenade falls largely prevents damage to the grenade 8. Additionally, a padding such as a mat may be provided under opening 7 in order to further reduce the risk of damage to grenade 8.

The alignment measuring unit 6 comprises an electronic magnet compass, for direction (azimuth) measurement, and an angular measuring system (inclinometer), for the determination of the elevation and the tilting angle of launcher tube 3. The alignment measuring unit is mounted along with a radio data transmitting unit 9 and a GPS unit 10, for the determination of the position of the simulator, on a support 11 which is attached to launcher tube 3.

The determination of the geographic position and of the elevation and the tilting angle is easily possible with sufficient precision from currently available components. The determination of the direction, however, is problematic. Up to now, in numerous tests, a sufficient precision could only be achieved by the mentioned magnetic compass sensor. However, sensor types may be used or achieved in the future, as the case may be. The assumed limit with respect to the angular precision is 10 artillery ‰ equivalent to a dispersion of ≦10 m at a range of 1 km, or to an angular resolution of ½° at the launcher tube. As is well known in Switzerland, the term "artillery ‰" refers to a system of measurement where a full circle is divided into 6400‰. Thus, 10 artillery ‰ percent refers to $^{10}/_{6400}$ of angular rotation.

The inside of launcher tube 3 accommodates evaluating unit 12, including a disadjusting device, and a battery 13 serving for the power supply of the mine thrower simulator. All of these measuring and control modules 6, 9, 10, 12, 13 are mutually connected by power supply, signaling and data lines The disadjusting device, e.g. in the form of an eccentric drive, simultaneously represents the connection between launcher tube 3 and bearing ball 14 resting on base plate 2. After each shot, the disadjusting device is activated by evaluating unit 12 in order to alter the alignment of the launcher tube. In this manner, the disadjustment is simulated, i.e. the effect of the concussion of a real mine thrower at the time of the shot.

Figure 2:
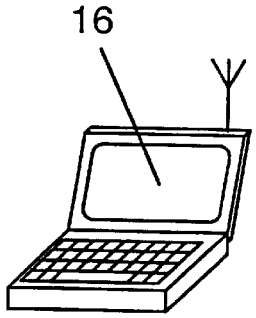
FIG. 2 shows a top, right, front perspective view of an evaluating unit constructed according to the invention.

The data obtained by thrower evaluating unit 12 are radio transmitted at every shot by transmitter unit 15 to an evaluating device 16 (FIG. 2). Evaluating device 16 is generally in the custody of the trainer and serves for the supervision of the correct operation of the mine thrower simulator, on one hand, and performs a calculation of the trajectory and of the virtual point of impact of the shot, on the other hand. Device 16 may e.g. be a portable computer ("laptop") provided with a corresponding receiver.

Figure 3:
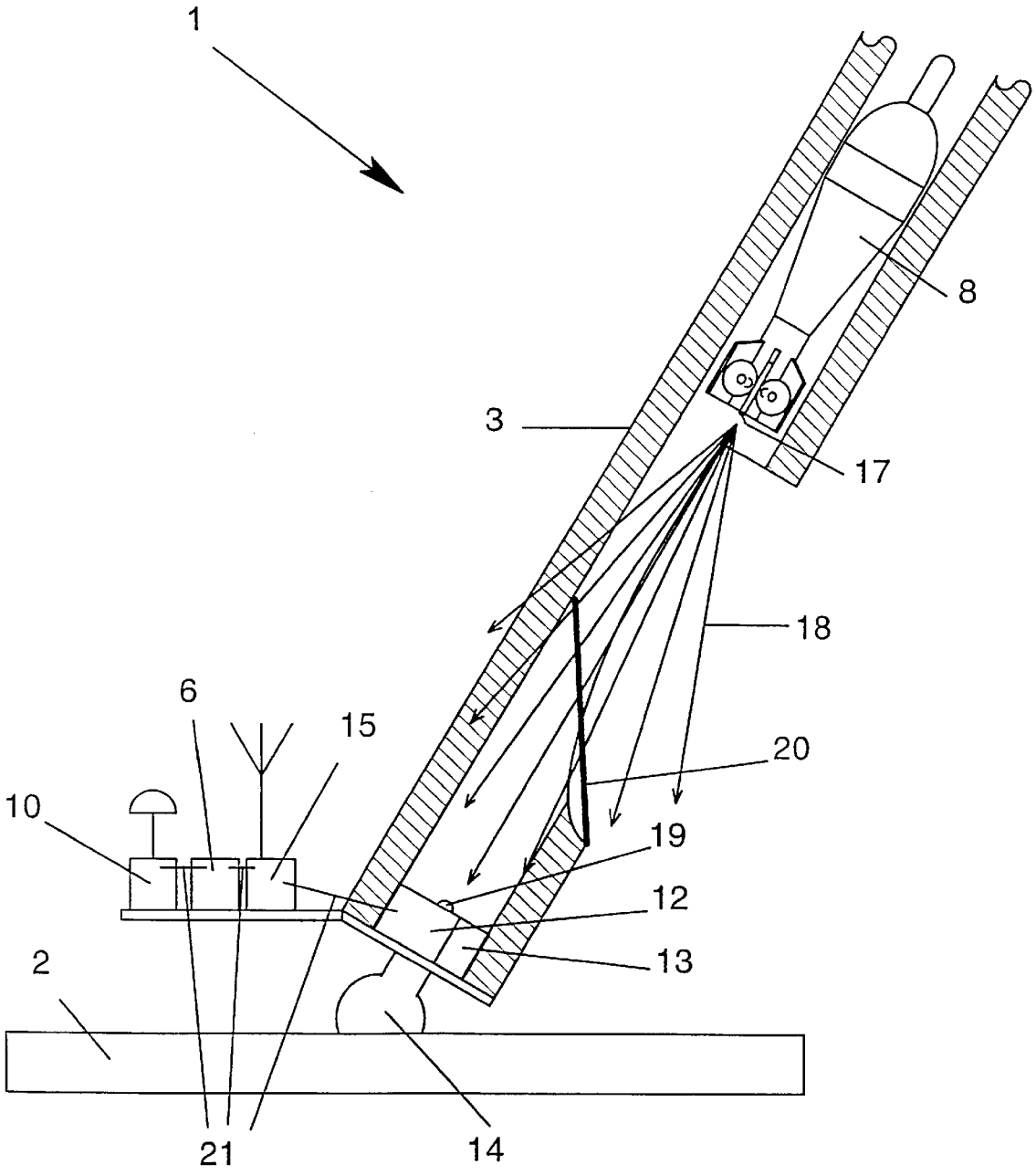
FIG. 3 shows a partial cross-sectional view of the mine thrower simulator of FIG. 1.

FIG. 3 shows a section of mine thrower simulator 1 in an enlarged illustration. A grenade 8 is in the process of sliding down within launcher tube 3. Its lower end carries an optical transmitter 17 which allows the transmission of data from the firing control within grenade 8 in the form of light signals 18. These light signals 18 are detected by optical receiver 19 and supplied to launcher control 12 for evaluation. Since transmitter 17 transmits a light cone of a suitably selected opening angle, the intensity of the light signal detected by receiver 19 increases as grenade 8 is approaching. This dependence of the intensity in function of the distance is used in order to detect a grenade sliding down within tube 3 (as opposed to a grenade which is introduced into the tube end prior to firing and which is still being held) The disappearance of the light signal when grenade 8 falls from outlet opening 7 may serve to trigger the simulation of the shot, i.e. as an equivalent to the ignition of the propelling charge of a real grenade.

Guiding plates 20 are provided in the area of outlet opening 7 which guide grenade 8 out of the tube even if launcher tube 3 is in an almost vertical position. Guiding plates 20 comprise a passage or a window for light signal 18.

Figure 4:
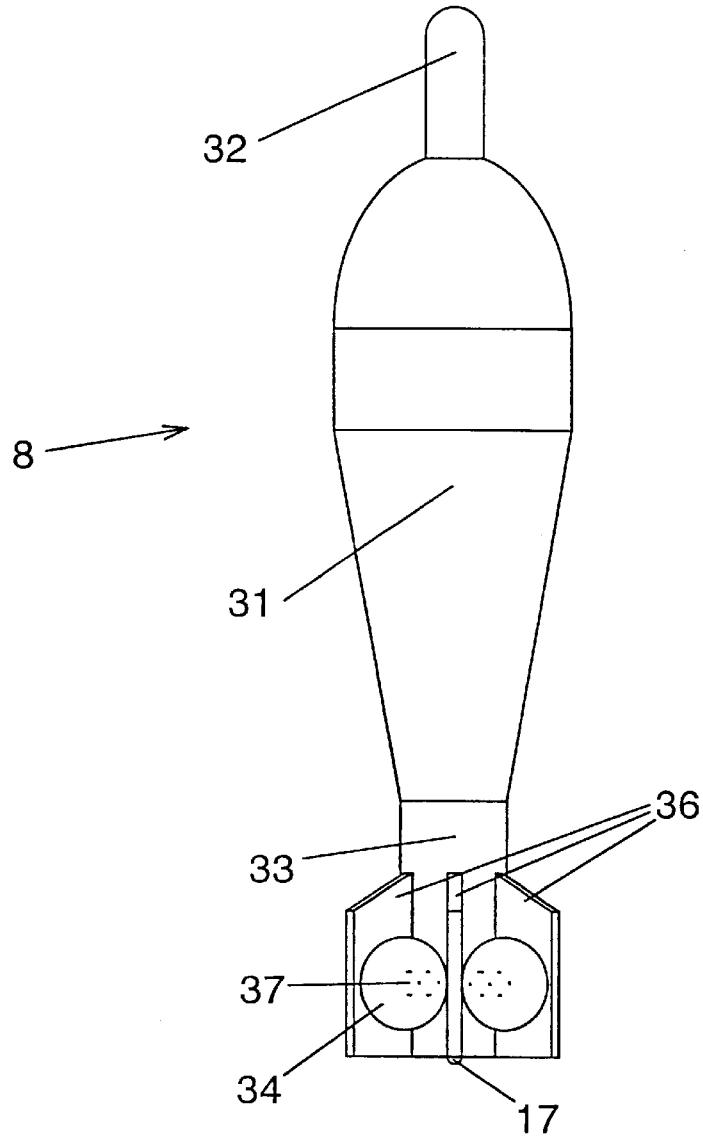
FIG. 4 shows a side elevational view of a shot for the mine thrower simulator of FIG. 1.
Figure 5:
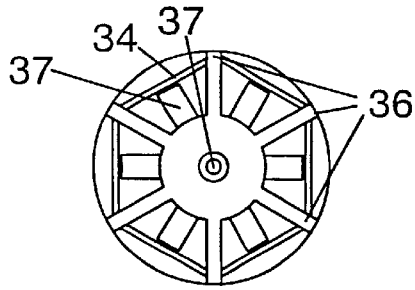
FIG. 5 shows a bottom view of the mine thrower simulator of FIG. 4.
Figure 7:
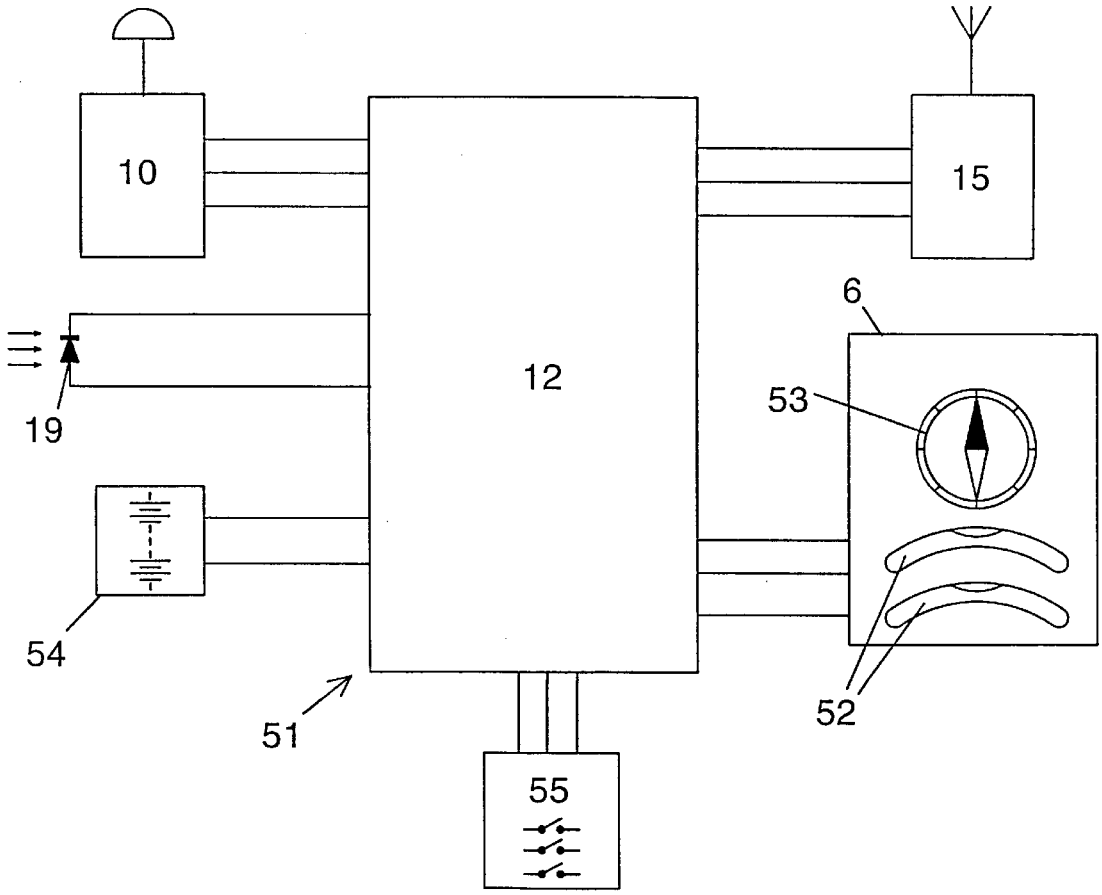
FIG. 7 shows a block diagram of the electronics of the mine thrower simulator.

FIGS. 4 and 5 show a grenade 8 in an enlarged view. It is essentially composed of body 31, fuse 32 and tail unit 33 with additional charges in the form of plates 34. As in a real grenade, fuse 32 is screwed into body 31. By a mark at the end of the fuse which is screwed into body 31, firing control 35 (FIG. 7) is capable of recognizing the actual type of fuse (contact, retarded, time fuse, etc.) In this manner, the usual types of ammunition and applications can be represented by the same grenade model, while illegal combinations may be recognized by firing control 35 or in evaluating device 16, as the case may be, e.g. a contact fuse in an illuminating grenade.

Additional charge plates 34, in the case of the simulation shot in the form of simple plates which preferably resemble additional charges, are inserted in respective seats between two fins 36. In order to allow firing control 35 to recognize how many additional charge plates have been attached, which permits calculations of the length of the trajectory, respective sensors 37 for the additional charge plates are disposed between each pair of fins 36. Sensors 37 may e.g. be optical (reflection light barrier) or inductive sensors. In the case of inductive sensors, plates 34 are made of metal or of a metallized support material.

Transmitter 17 is disposed at the lower end of tail surfaces 33.

The foregoing exemplary simulation shot greatly reduces training costs. Grenade ejection, even by a reduced propelling charge, generates high temperatures in the tail surfaces because the propelling gases resulting from the combustion of the propellant are very hot and under high pressure. Also, firing control 35 within the grenade is subject to a high acceleration, thus exposing firing control 35, sensors 37, and transmitter 17 to the risk of being damaged and correspondingly requiring an expensive temperature-, pressure-, and acceleration-resistant components. Thus, simulated launching reduces the cost of training materiel.

Figure 6:
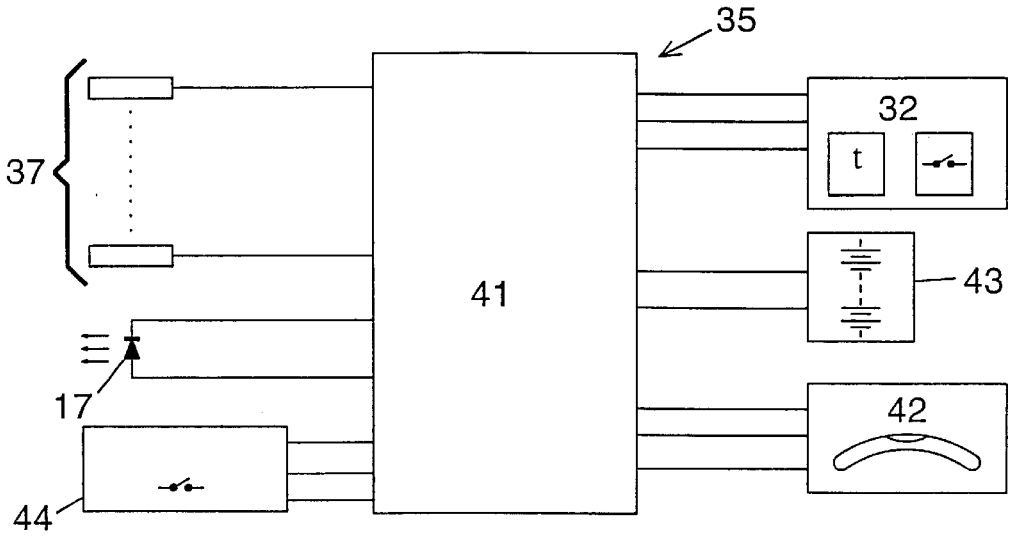
FIG. 6 shows a block diagram of the electronics of a simulation shot.

FIG. 6 shows a block diagram of firing control 35. It includes a central unit 41 which essentially consists of a microcontroller. As an energy source 43, a capacitor of an extremely high capacity is used, e.g. a gold-cap capacitor. To conserve energy, the firing control is switched on by an inclination sensor 42 only when the angle of the grenade with respect to the horizontal direction is in the range of the elevation of the mine thrower simulator (e.g. 45° to 90°).

The energy source is preferably charged while the grenade is stored in a special transport container (not shown). For this purpose, the transport container is provided with a battery, inter alia. The energy may be transmitted by electric contacts on grenade 8 and in the container or in a wireless manner e.g. by inductive means.

Energy source 43 is configured to be essentially used up after a shot, precluding the unrealistic immediate reuse of the grenade after its "firing". Rather, after firing, the grenade must be returned to the transport container and left therein until the energy source is recharged.

In the case of energy sources having a greater capacity, it is necessary for a realistic simulation that the grenade is deactivated after firing or generates a special signal which indicates that the grenade has been used.

Central unit 41 actuates transmitter 17 which generates light signals 18 for the transmission of data.

Further, optional sensors 44 may be provided in addition. For example, a luminosity sensor responding to the absence of light in tube 3 could be used in combination with inclination sensor 42 in order to detect a shot, or an acceleration sensor which detects the shot by the impact of grenade 8 on the bottom of the launcher tube, on the deflecting device or on the base plate individually or in combination with inclinometer 42. Furthermore, it is possible to use other sensors incorporated in the grenade, e.g. switches, optical, inductive or capacitive sensors, individually or in combination in order to determine whether the grenade is in the launcher tube.

The control system 51 (FIG. 7) of the thrower consists of evaluating unit 12 and of position sensor 10 (GPS unit), elevation/tilting sensor 52 (inclinometer) and direction sensor 53 (compass) connected thereto. The light signals transmitted by a grenade 8 in launcher tube 3 are received by light detector 19 whose output signals both represent a measure of the distance of grenade 8, i.e. of its position in launcher tube 8, and provide information with respect to the grenade which is transmitted by the firing control.

The firing data, i.e. all data which are necessary in order to calculate the shot, are transmitted to evaluating unit 16 by transmitting unit 15. Energy source 54 is a battery or an accumulator.

Furthermore, by means of control unit 55, the mine thrower simulator can be set to represent different real thrower types which are e.g. characterized by different caliber.

Hereinafter, a typical training sequence will be described. The mine thrower simulator is set up and directed to a target. The trainer continuously surveys the operations by means of the data indicated by the evaluating unit. According to the aimed (virtual) target and the firing parameters, the mine thrower simulator is aligned and the required number of grenades are prepared by the gunner. As the grenades are lifted up and tilted according to the inclination of the tube, firing control 35 is activated, provided that a fuse is screwed in and (virtually) armed. While the grenade slides down in launcher tube 3, the characteristic data of the grenade are transmitted to thrower control 51, which delivers them to evaluating device 16 along with the data concerning the orientation of the launcher tube. The evaluating device calculates the trajectory and the point of impact on the base of these data and/or delivers a message in the case of illegal operating conditions.

When the grenade drops out through outlet opening 7, it is deactivated either by lack of energy or by the fact that the firing control is automatically blocked after the simulation of a shot. It is also possible that data are transmitted from the mine thrower simulator to the grenade in the launcher tube for this particular purpose.

Since the described mine thrower simulator neither produces a firing noise—although it could be generated, as the case may be, by a noise generator, however at a substantially lower level, in view of a realistic simulation nor are the grenades ejected, the device allows for training almost anywhere, e.g. also in developed areas or in halls.

In a real mine thrower, the grenades in the launcher tube are slowed down by an air cushion formed under them on account of the necessary, relatively tight contact with respect to the tube wall. Due to the outlet opening, such an air cushion cannot form in the simulator. In view of a more realistic sliding time of the grenades in the tube, in particular for the training of serial fire, the friction of the grenades on the tube wall may be increased by suitable measures such as a tighter fit at least locally, special material combinations, or the attachment or insertion e.g. of felt surfaces or similar materials on or in surface sections of the grenades which are in contact with the tube wall, and/or in the tube wall. In addition, it is possible to keep outlet opening 7 closed by a cover, to drop the grenade on the bottom of the launcher tube in the free fall or in a retarded manner, and to open the cover preferably after the typical delay between the insertion and the ignition of the grenade. The cover may e.g. by opened by the action of the own weight of the grenade, by an auxiliary drive (motor), or by the stored energy of the descending grenade. If it is suitably shaped, the cover may additionally serve to remove the grenade from the launcher tube in a relatively gentle and defined manner.

The cover may also be kept closed by an electromagnet, so that the control system of the mine thrower simulator can release the cover by an electric signal. Under the weight of the grenade, possibly reinforced by its kinetic energy, the cover is forcibly opened and the grenade slides out. Subsequently, the cover is automatically closed by a return spring.

A possible alternative of the controlled opening could be to dimension the closing spring in such a manner that the cover is automatically opened by the weight of the grenade. However, it is sufficient if the cover only closes the outlet opening in such a manner that the grenades can no longer fall out of the tube.

In simulators for mine throwers which do not fire automatically but where a grenade within the launcher tube is externally fired, e.g. by means of a release line, a cover of this kind or an equivalent closure device must be provided. Only when the release is actuated, the simulation is triggered, on one hand, and the cover opened, on the other hand, so that the grenade can drop out.

In order to slow down the grenade while it is falling out, the return spring element can be made so strong that an effective braking of the grenade results from a squeezing action between the launcher tube and the cover. In addition, the cover may be provided with a kind of guide, e.g. in the form of a short tube section, and/or with a lining for an increased friction (felt or spring strips) in order to reduce the falling velocity of the grenades.

Alternatives of the foregoing exemplary embodiment are available to those skilled in the art without leaving the scope of the invention as claimed.

It is possible, for example, to provide an additional detection unit operating according to the echo method, e.g. an ultrasonic detector in the tube which allows to detect the presence and movement of a grenade in the launcher tube independently, and/or inductive sensors for this purpose on the launcher tube.

With respect to the distinct external shape of different types of ammunition, particularly of illuminating and explosive ammunition, it may also be advantageous to make the body variable, e.g. by an interchangeable envelope.

The measuring and evaluating units provided on the simulator may be arranged differently. It is e.g. possible that all parts are disposed inside the launcher tube, so that only the antenna of transmitting unit 15 is possibly mounted on the outside. It is also conceivable to dispose the compass at another suitable location, e.g. on base plate 2, in which case, however, the angular difference between base plate 2 and bearing ball 14 of the launcher tube must be measured by a suitable measuring device, e.g. an optical angular transmitter, and taken into account in the evaluation. Also, in the reactivation resp. recharging of the grenades, e.g., as suggested, in the transport container, a possibility of reprogramming the grenades e.g. as explosive or illuminating ammunition could be provided. In this manner, only one kind of programmable ammunition would be sufficient for the simulation of a large number of real ammunition types. The programming, and maybe even the connection of a fresh energy source, could also be effected by the exchange of the envelope described above.

What is claimed is:

1. A simulator for front-loaded barrel weapons comprising:

a simulated shot; and a launcher tube having a lower end shaped for receiving said simulated shot therein and provided with an outlet opening on a lower surface of said tube allowing said simulated shot to drop out of said tube.

2. The simulator of claim 1, further comprising a closure device wherein said outlet opening is closed by said closure device such that a grenade cannot fall through said outlet opening, and a release device which allows opening said closure device and said outlet opening.

3. The simulator of claim 2, wherein said closure device in an open condition is pushed into a closed position by pressure means.

4. The simulator of claim 1, further comprising at least one guiding means for ensuring a disturbance-free dropout of the shot from said outlet opening.

5. The simulator of claim 1, further comprising braking means disposed in said launcher tube for adapting the falling time of a shot in said launcher tube to realistic conditions.

6. The simulator of claim 1, further comprising means for determining a geographic position, means for determining an elevation of said launcher tube, means for determining a present alignment of said launcher tube or combinations thereof.

7. The simulator of claim 1, further comprising means for receiving data signals provided at said lower end of said launcher tube transmitted by a shot in the launcher tube.

8. The simulator of claim 7, wherein said receiving means is adapted for generating a signal of which at least one parameter is a function of the position of a shot in said launcher tube and/or of the presence of a shot in said launcher tube, in order to release a firing simulation by the detection of a shot descending in said launcher tube.

9. The simulator of claim 1, further comprising means for detecting a shot provided within said launcher tube at said lower end thereof, in order to determine a presence, a position and/or a movement of a shot in said launcher tube.

10. The simulator of claim 1, further comprising a displacing device for disadjusting said launcher tube simulating an effect of a real shot with respect to launch tube alignment.

11. The simulator of claim 1, further comprising a control device for monitoring at least one of operating conditions selected from a firing of a shot, an alignment of said launcher tube, a geographic position, a type of ammunition used for each shot and combinations thereof.

12. The simulator of claim 1, further comprising a sensor responding to the magnetic field of the earth coupled to said launcher tube in order to determine the direction thereof wherein metallic parts of said simulator are preponderantly made of an antimagnetic material to avoid a local perturbation of the earth magnetic field.

13. A shot for the simulator of claim 1, comprising:

a tail unit;

a body connectable with said tail unit; and a fuse detachably mounted to said body;

wherein said shot may simulate the function and/or the shape of different types of ammunition for mine throwers by exchanging the body and/or the fuse.

14. The shot of claim 13, further comprising transmitting means for transmitting a data signal indicating a type of ammunition simulated by said shot.

15. The shot of claim 14, wherein an intensity of said data signal decreases as a distance of said shot increases, thus allowing determination of a distance of said shot from a receiving means of said data.

16. The shot of claim 13, configured for receiving additional charge simulation units.

17. The shot of claim 16, wherein said additional charge simulation units comprise small plates which are attachable to said tail unit or to a neck of said shot, said shot further comprising attachment provisions for a certain maximum number of additional charge simulation units, each said attachment provision including a detector for detecting a presence of each said additional charge simulation unit in each respective said attachment.

18. The shot of claim 13 further comprising a firing control unit;

detection means for detecting a simulated firing of said shot and for transmitting a first signal containing corresponding information to said firing control and transmitting means for transmitting a second signal, said first signal corresponding to when said shot is fired for a first time which differs from said first signal transmitted when said shot is fired for a second time, thus allowing determination whether the same shot is used several times in succession.

19. A container for receiving a shot as claimed in claim 18, wherein a condition of said firing control unit prior to being fired for the first time is restored when said shot is placed in said container, said container comprising first connecting means for contacting complementary second connecting means in said shot;

wherein restoring is enabled by contact and/or signals exchanged during contact of said first and said second connecting means.

20. The simulator of claim 3, said pressure means including elastic spring elements.

21. The simulator of 3, further comprising means for exerting a braking action on a simulated shot exiting from said outlet opening to ensure a controlled dropout.

22. The simulator of claim 1, further comprising a ramp extending to a lower end of said outlet opening.

23. The simulator of claim 1, said launcher tube having an area of increased friction, a restriction or combinations thereof.

24. The simulator of claim 6, said means for determining a geographic position utilizing a GPS method.

25. The simulator of claim 7, wherein said data signals are selected from electromagnetic signals, acoustic signals, optical radiation and combinations thereof.

26. The simulator of claim 1, further comprising means for detecting additional charge simulation units mounted on the simulated shot.

27. The shot of claim 17, said detector being selected from inductive detectors, capacitive detectors, optical detectors and combinations thereof.

* * * * *